US008757131B2

(12) United States Patent
Allen et al.

(10) Patent No.: US 8,757,131 B2
(45) Date of Patent: Jun. 24, 2014

(54) FLUID INJECTOR HAVING A NOVEL INLET VALVE ARRANGEMENT

(75) Inventors: Jeffrey Allen, Attleborough (GB); Steven Barraclough, Wymondham (GB); Paul Bartholomew Ravenhill, Dereham (GB); Richard Matthew Hoolahan, Bunwell (GB)

(73) Assignee: Robert Bosch GmbH, Stuttgart (DE)

( * ) Notice: Subject to any disclaimer, the term of this patent is extended or adjusted under 35 U.S.C. 154(b) by 458 days.

(21) Appl. No.: 13/259,207

(22) PCT Filed: Mar. 31, 2010

(86) PCT No.: PCT/GB2010/000641

§ 371 (c)(1),
(2), (4) Date: Dec. 15, 2011

(87) PCT Pub. No.: WO2010/112856

PCT Pub. Date: Oct. 7, 2010

(65) Prior Publication Data

US 2012/0085323 A1 Apr. 12, 2012

(30) Foreign Application Priority Data

Mar. 31, 2009 (GB) ..... 0905578.1

(51) Int. Cl.
*F02M 69/04* (2006.01)

(52) U.S. Cl.
USPC ..... 123/472; 123/499; 239/585.1; 417/50; 417/471; 417/482

(58) Field of Classification Search
CPC ..... H02K 44/02; H02K 44/04; H02K 44/06; F02M 51/061; F02M 59/025; F02M 59/464; F02M 69/04; F02M 69/043; F02M 69/044; F02M 2051/08; F02M 2200/16
USPC ..... 123/472, 499; 239/585.1, 585.3; 417/50, 471, 482
See application file for complete search history.

(56) References Cited

U.S. PATENT DOCUMENTS 5,915,929 A * 6/1999 Falk et al. ..... 417/415
6,127,750 A * 10/2000 Dadd ..... 310/13

(Continued)

FOREIGN PATENT DOCUMENTS

DE 1911534 A1 9/1970
DE 19917009 A1 10/2000

(Continued)

OTHER PUBLICATIONS

European Patent Office, International Search Report, date Aug. 6, 2010, PCT/GB2010/000641 (3 pages).

(Continued)

*Primary Examiner* — Erick Solis
(74) *Attorney, Agent, or Firm* — Luedeka Neely Group, PC

(57) ABSTRACT

With reference to FIG. 3, the present invention provides a fluid injector (10) which functions as a positive displacement pump and comprises: a housing (12) in which a piston chamber is formed; a piston (11) which reciprocates in the piston chamber to define therewith a variable volume fluid pumping chamber; a one-way inlet valve (32) which allows flow of fluid into the pumping chamber from a fluid inlet; and a one-way outlet valve (25, 26, 27, 28, 29) which allows flow of fluid out of the pumping chamber to a fluid outlet (31). In operation of the injector the piston (11) cyclically moves to increase volume of the pumping chamber and draw fluid into the pumping chamber via the one-way inlet valve (32) and then the piston moves to decrease volume of the pumping chamber and expel fluid from the pumping chamber via the one-way outlet valve (25, 26, 27, 28, 29).

39 Claims, 12 Drawing Sheets

(56) References Cited

U.S. PATENT DOCUMENTS

| | | | | |
|---|---|---|---|---|
| 6,223,724 | B1 | 5/2001 | Miyaji et al. | |
| 6,871,800 | B2 * | 3/2005 | Tinwell et al. | 239/533.2 |
| 7,762,478 | B1 * | 7/2010 | Czimmek et al. | 239/102.2 |
| 2003/0047625 | A1 * | 3/2003 | Tinwell et al. | 239/585.4 |
| 2004/0062660 | A1 * | 4/2004 | Kazahaya et al. | 417/222.1 |
| 2006/0289682 | A1 * | 12/2006 | Kammerer et al. | 239/533.8 |
| 2007/0237663 | A1 | 10/2007 | Kim | |
| 2009/0223244 | A1 * | 9/2009 | Kimoto et al. | 62/470 |
| 2010/0260619 | A1 * | 10/2010 | Taguchi et al. | 417/213 |
| 2013/0061830 | A1 * | 3/2013 | Hornby et al. | 123/446 |

FOREIGN PATENT DOCUMENTS

| | | | |
|---|---|---|---|
| EP | 0962649 | A1 | 12/1999 |
| EP | 1724467 | A1 | 11/2006 |
| GB | 2452954 | A | 3/2009 |

OTHER PUBLICATIONS

European Patent Office, PCT International Preliminary Report on Patentability, date May 4, 2011, PCT/GB2010/000641 (6 pages).

Search and Examination Report, dated Sep. 29, 2009, Application No. GB0905578.1 (10 pages).

* cited by examiner

FLUID INJECTOR HAVING A NOVEL INLET VALVE ARRANGEMENT

CROSS-REFERENCE TO RELATED APPLICATION

This application claims priority under all applicable rules and statutes to International Application No. PCT/GB2010/000641 filed Mar. 31, 2010, and entitled A FLUID INJECTOR HAVING A NOVEL INLET VALVE. ARRANGEMENT, which claims priority to GB 0905578.1, filed Mar. 31, 2009, incorporated herein by reference in their entireties.

The present invention relates to a fluid injector having a novel inlet valve arrangement.

Most internal combustion engines in automobiles currently use fuel injection systems to supply fuel to the combustion chambers of the engine. These fuel injection systems have replaced the earlier technology of carburettors because they give better control of the delivery of fuel and enable the engine to meet emissions legislation targets as well as improving overall engine efficiency.

In internal combustion engines in automobiles fuel injection systems most often work by having a high pressure fuel supply rail and injectors which are on/off valves which can be switched open to allow the delivery of fuel via a suitable nozzle and then closed to stop delivery of fuel. The quantity of fuel delivered in each engine cycle is controlled by the amount of time that the valve is opened in each cycle. Whilst such systems are very efficient and allow good control of the delivery of fuel, they are typically too complex and too expensive for installation in small engines such as the engines used in gardening equipment, e.g. lawnmowers and small motorcycles. To date such engines have continued to use carburettors.

In GB2421543 the Applicant disclosed a fuel injection system suitable for small engines in which an injector works as a positive displacement pump and dispenses an amount of fuel which is fixed for each and every operation of the injector. The injector is controlled by an electronic controller to operate a plurality of occasions in each of at least a majority of engine cycles. With increasing engine speeds and/or loads the controller increases the amount of fuel delivered per engine cycle by increasing in number the occasions that the fuel injector is operated during the engine cycle. Conversely, in response to decreasing engine speeds and loads the controller reduces the amount of fuel delivered by reducing in number the occasions the fuel injector is operated per engine cycle. The quantity of fuel delivered in an engine cycle can be varied in discrete steps by varying the number of operations of the injector in the cycle.

Starting with the principles involved in GB2421543, the applicant has worked to refine and improve the operation of the fuel injector described therein. To this end, the applicant has worked on improving the design of the inlet valve used to control flow of fluid into a fuel chamber in the injector from which the fuel is later dispensed under movement of a piston. Improved inlet valve designs have been disclosed in GB2452954. In this patent specification the inlet valves are shown attached to and moving with a piston which reciprocates in the fuel chamber to draw fuel into and expel fuel from the chamber. Fuel flows into the fuel chamber through apertures provided in the piston, under control of the inlet valve. The inlet valve comprises itself an annular support with curved spring arms extending inwardly therefrom to valve heads.

The present invention in a first aspect provides a fluid injector as claimed in claim 1.

The present invention in a second aspect provides a fluid injector as claimed in claim 23.

The present invention in a third aspect provides a fluid injector as claimed in claim 27.

The present invention in a fourth aspect provides a positive displacement pump as claimed in claim 34.

The present invention in a fifth aspect provides a positive displacement pump as claimed in claim 38.

The present invention in a sixth aspect provides a positive displacement pump as claimed in claim 39.

Preferred embodiments of the present invention will now be described with reference to the accompanying drawings in which.

Figure 1:
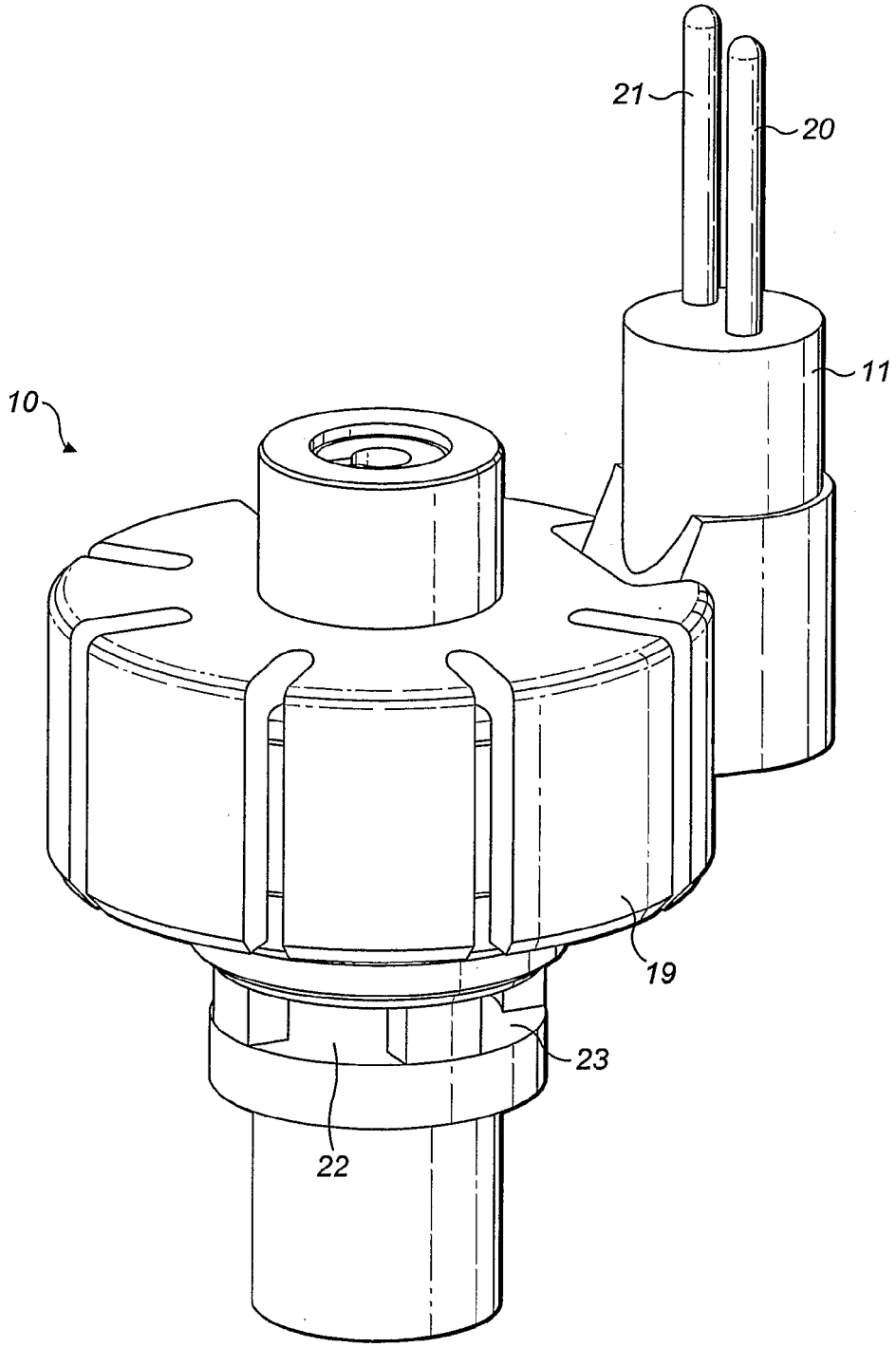
FIG. 1 is a perspective view of a first embodiment of fluid injector according to the present invention.
Figure 2:
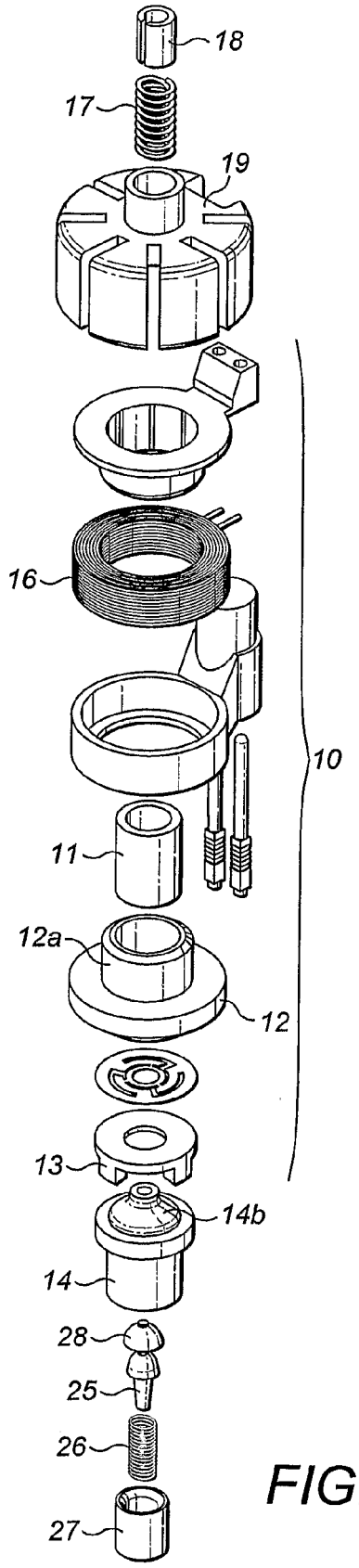
FIG. 2 is an exploded view of the fluid injector of FIG. 1.
Figure 3:
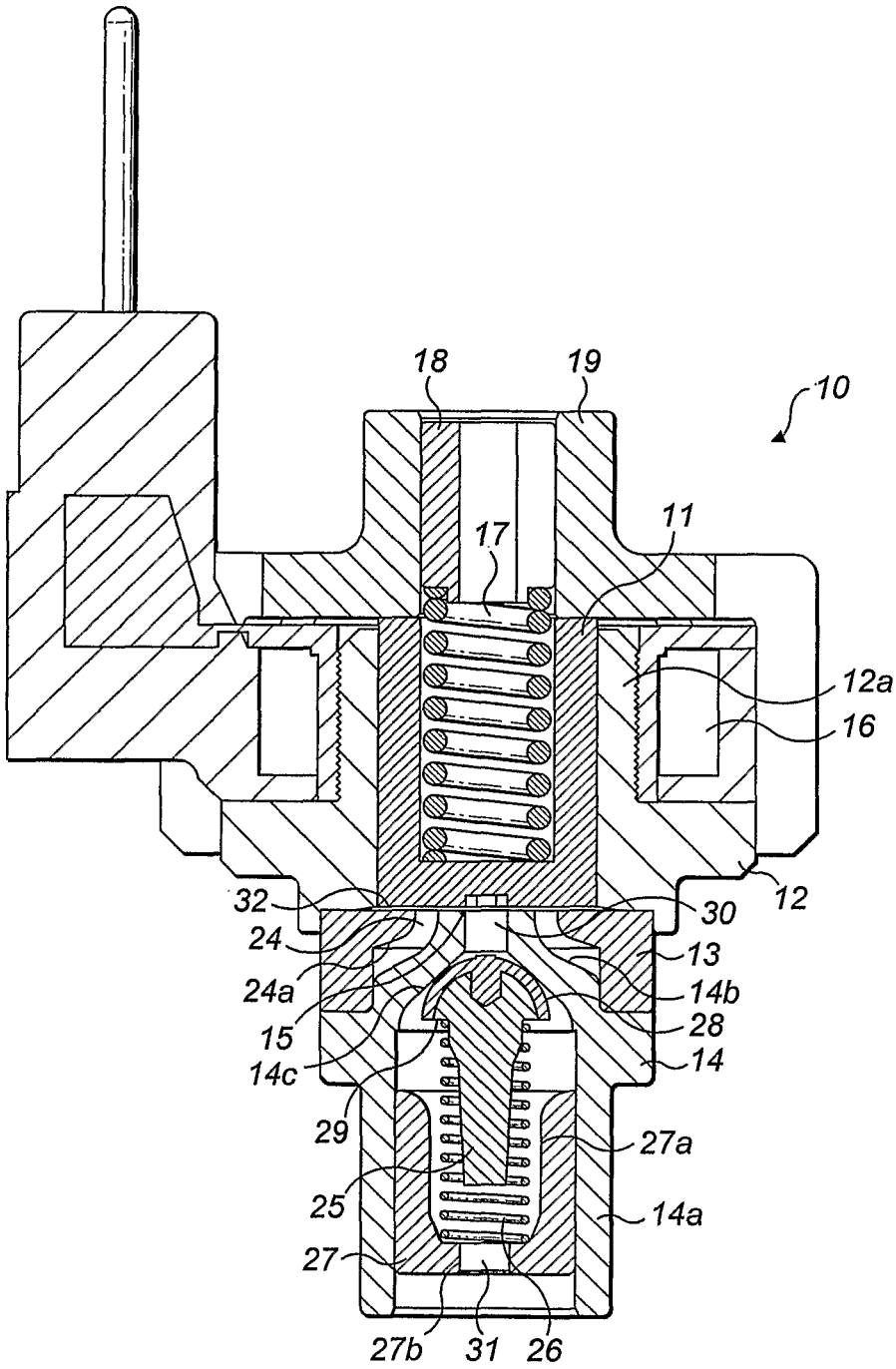
FIG. 3 is a cross-section through the fluid injector of FIG. 1.
Figure 6A:
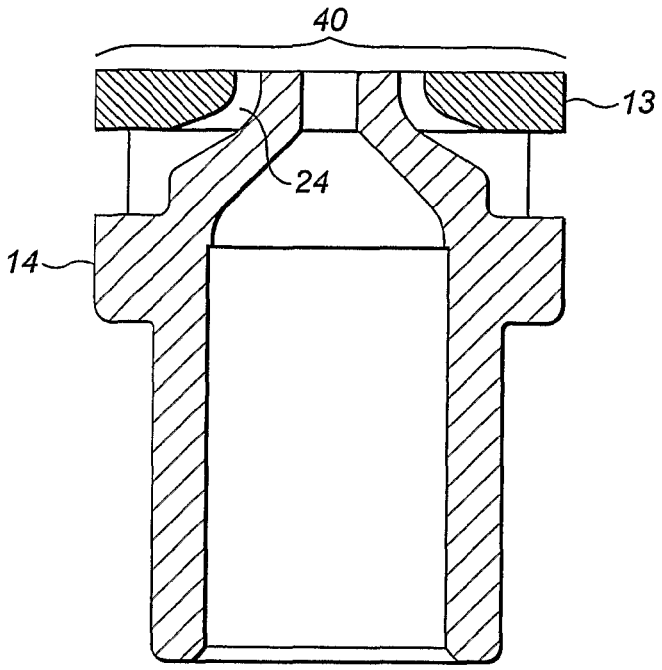
Figure 6B:
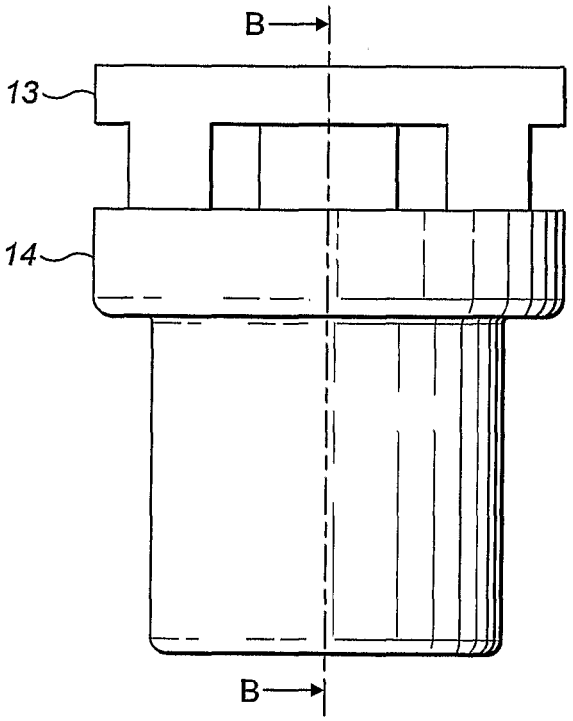

FIG. 6*a* is a cross-section through an intake and delivery sub-assembly of the fluid injector of FIGS. 1 to 3, taken along the line B-B of FIG. 6*b;*

FIG. 6*b* is a side elevation view of the intake and delivery sub-assembly shown in FIG. 6*a;*

Figure 6C:
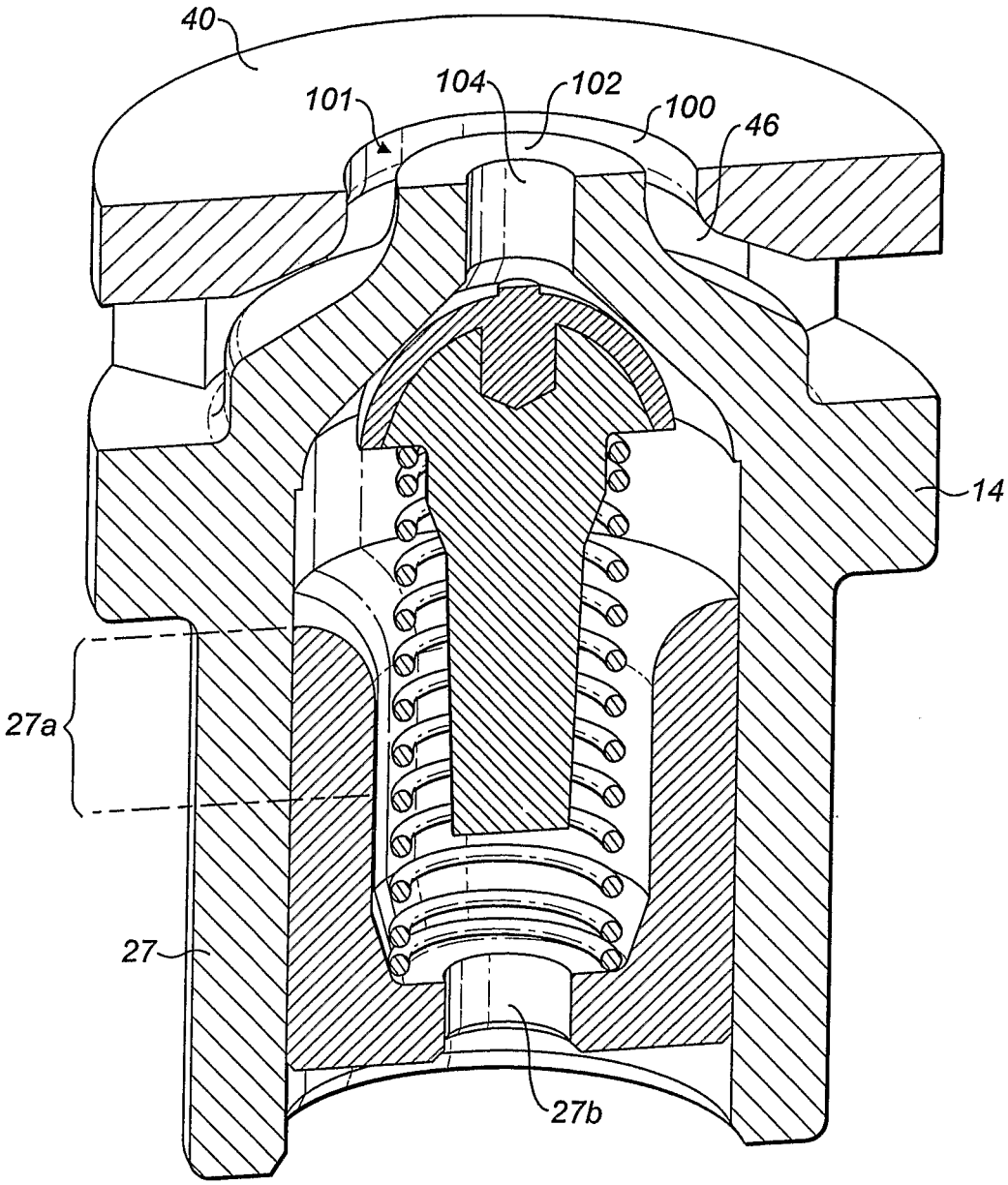

FIG. 6*c* is a further, perspective in cross-section, view of the intake and deliver sub-assembly of FIGS. 6*a* and 6*b;*

Figure 4:
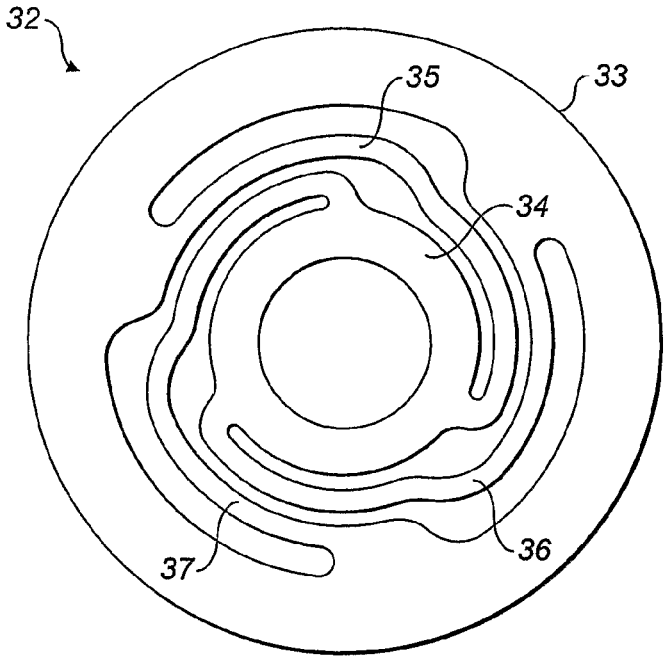
FIG. 4 is a plan view of an intake valve used in the injector of FIGS. 1 to 3.
Figure 5:
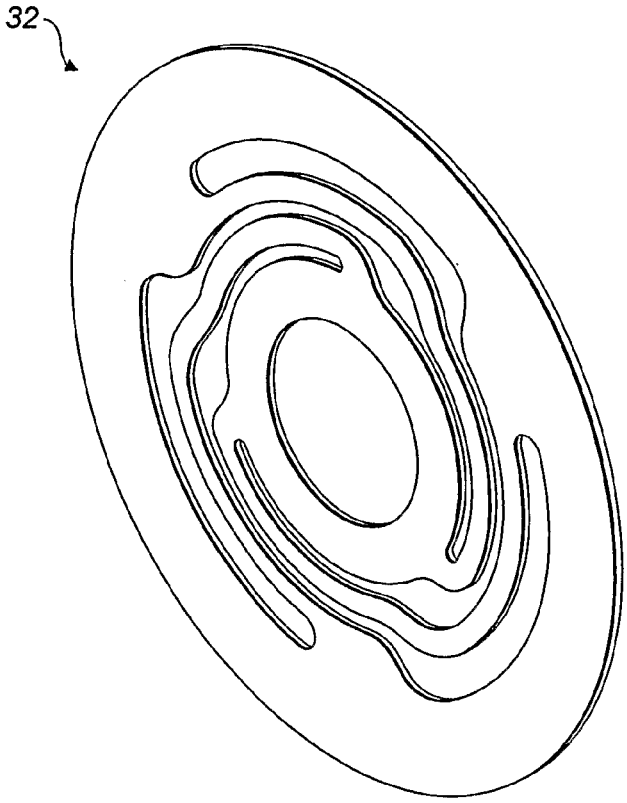
FIG. 5 is a perspective view of the FIG. 4 intake valve.
Figure 7A:
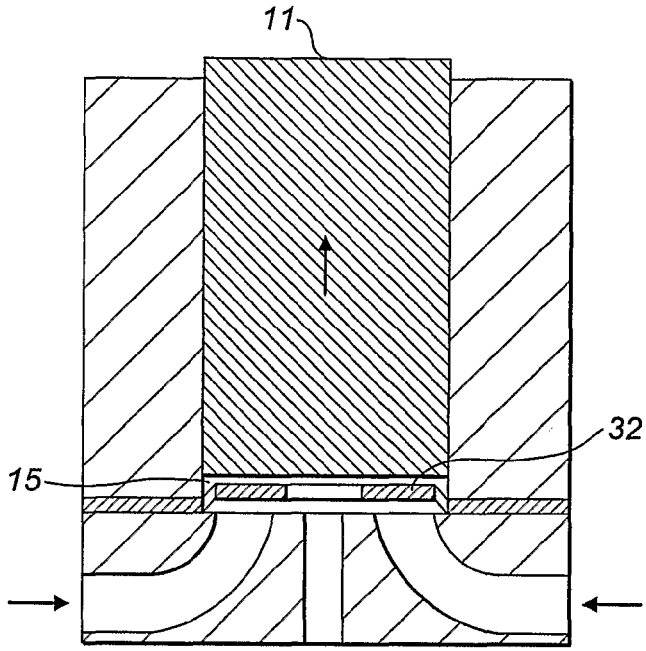
Figure 7B:
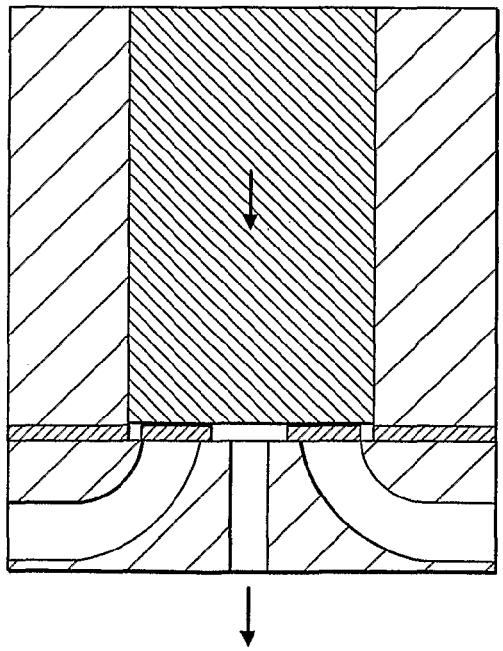
Figure 8A:
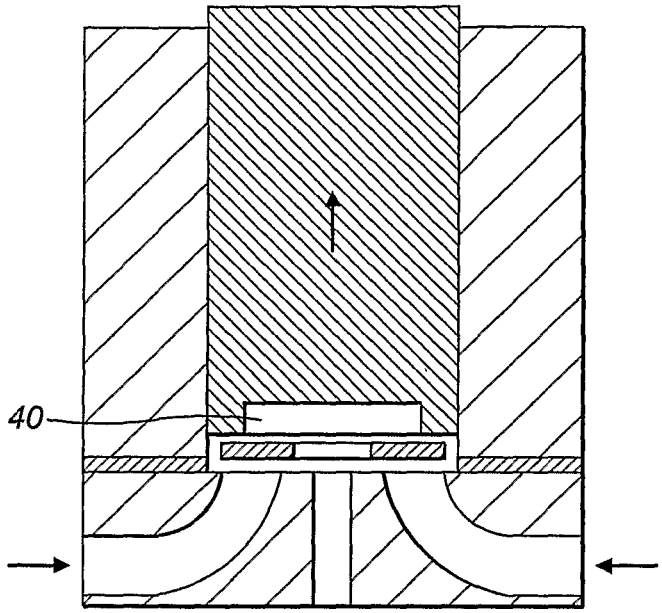
Figure 8B:
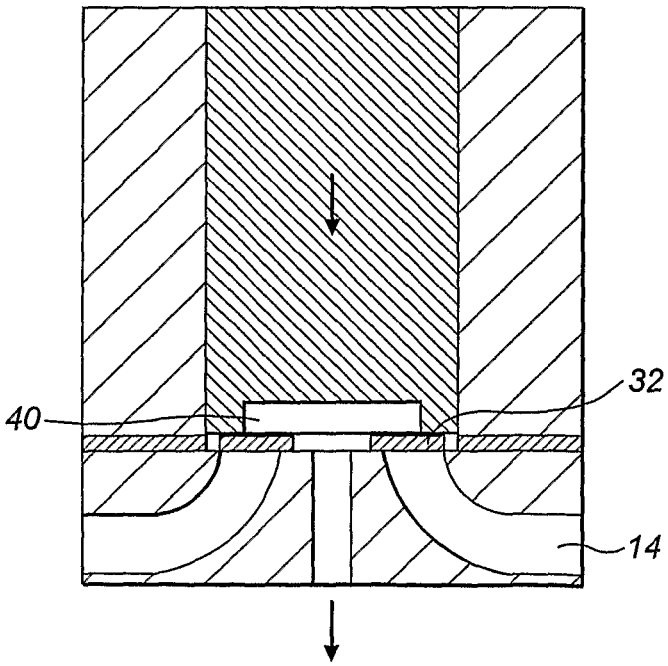
Figure 9:
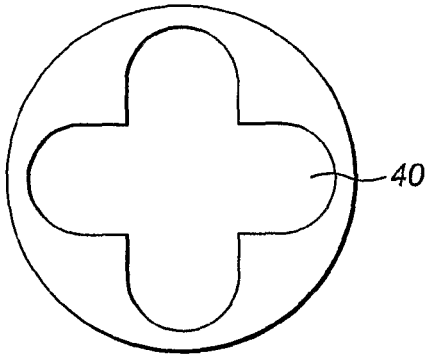

FIG. 7*a* and FIG. 7*b* show operation of the intake valve of FIGS. 4 and 5;

FIG. 8*a* and FIG. 8*b* show a variant of the fluid injector described in the earlier figures, having a piston with a modified end face operable in a variable volume pumping chamber;

FIG. 9 shows schematically a front face of a piston as illustrated schematically in FIGS. 8*a* and 8*b;*

Figure 10A:
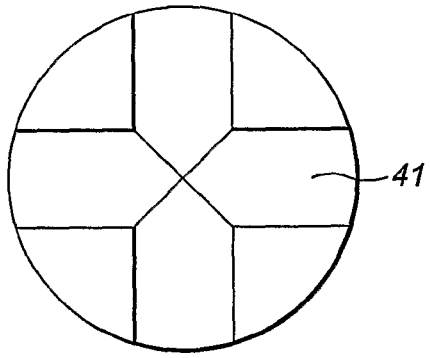
Figure 10B:
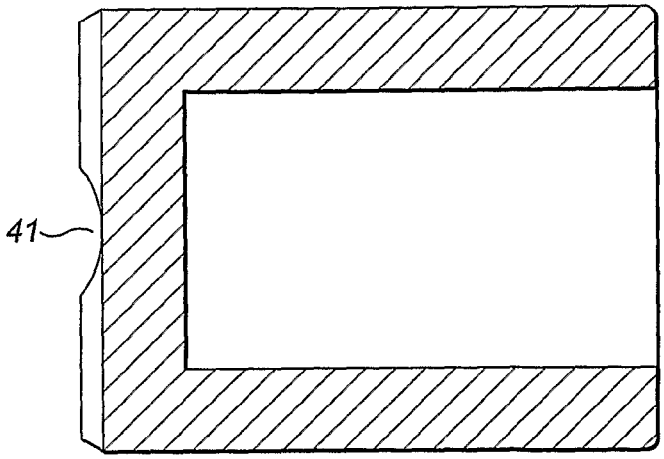

FIGS. 10*a* and 10*b* respectively show a front end face and a cross-section through a piston which is suitable for use in the variant of fluid injector illustrated schematically in FIGS. 8*a* and 8*b;*

Figure 11A:
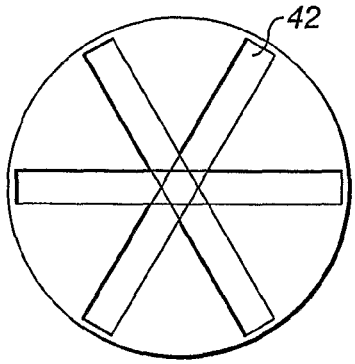
Figure 11B:
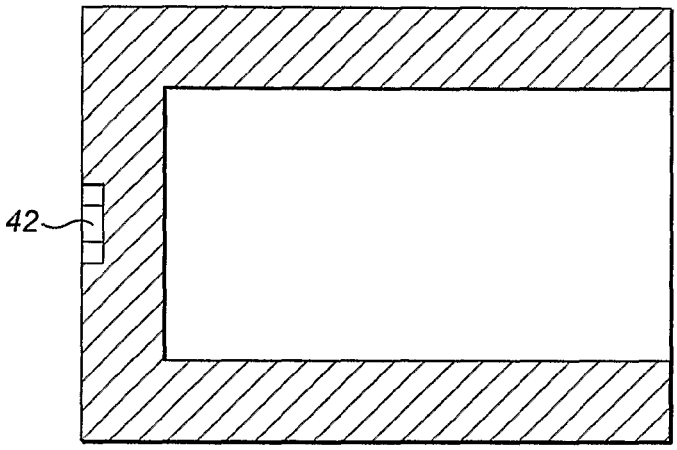
Figure 11C:
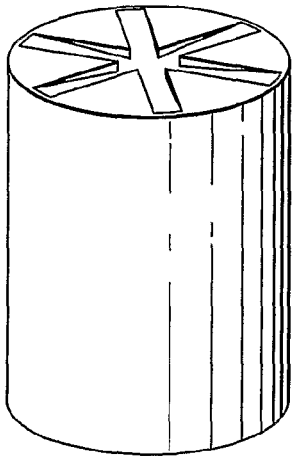
Figure 12A:
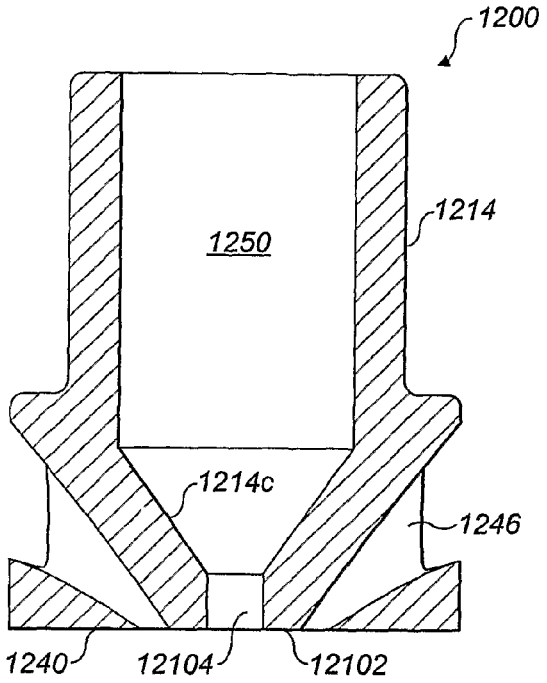
Figure 12B:
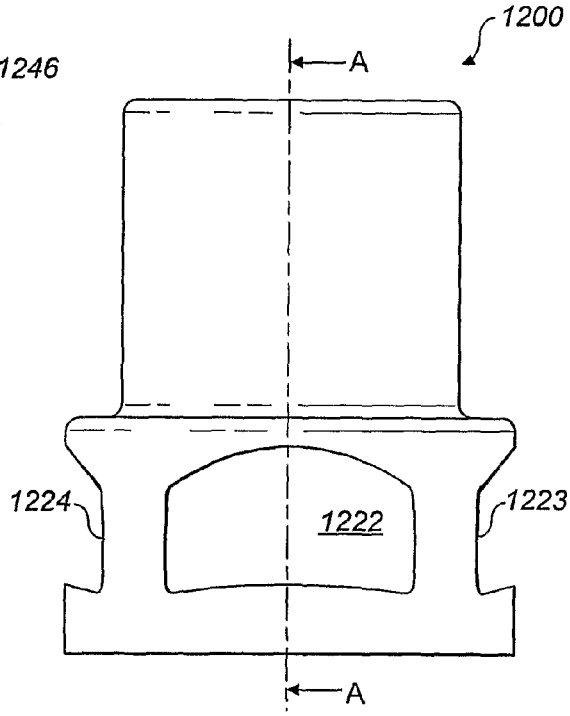

FIGS. 11*a*, 11*b* and 11*c* are respectively an end view showing a face of a piston suitable for use in the variant illustrated schematically in FIGS. 8*a* and 8*b*, a cross-section through the same piston and a respective view of the piston;

FIG. 12*a* is a cross-section through a component which integrates a valve seat member and a delivery nozzle and which can be used in the fluid injector of FIGS. 1 to 3 in place of the separate valve member and delivery nozzle of FIGS. 6*a* and 6*b* (the cross-section is taken along the line A-A in FIG. 12*b*);

FIG. 12*b* is a side elevation of the component of 12*a;*

Figure 12C:
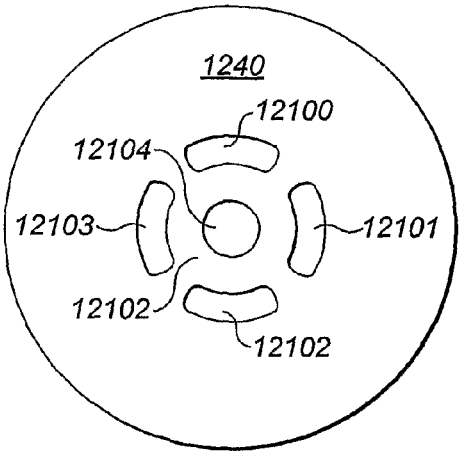
Figure 12D:
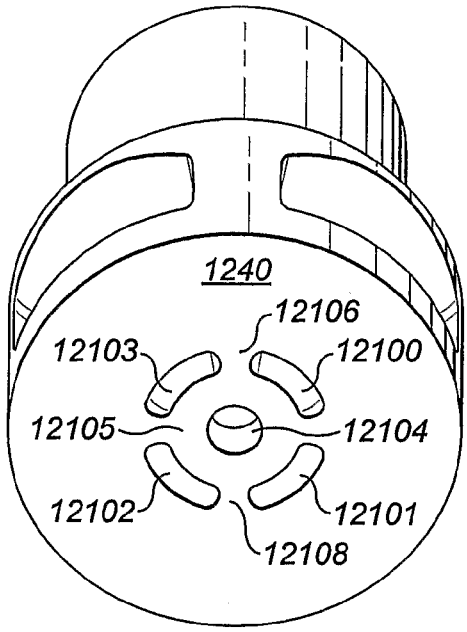
Figure 12E:
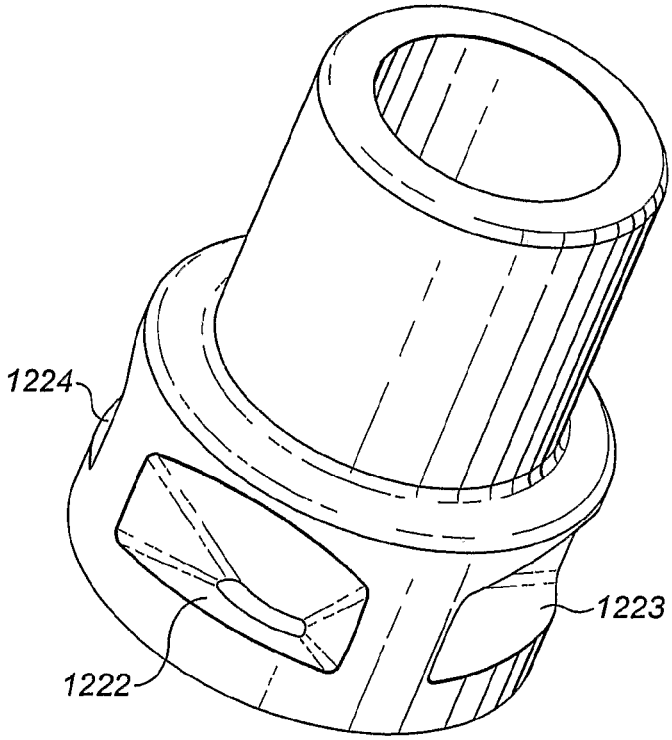

FIG. 12*c* is a plan view of the component of FIGS. 12*a*, 12*b*; and FIGS. 12*d* and 12*e* are perspective views of the components illustrated in FIG. 12.

The present invention will be described with particular reference to use of the fluid injector as a gasoline fuel injector in an internal combustion engine, because it is ideally suited for such a purpose. However, the injector is equally suited to the delivery of other fluids, as will be described later.

FIG. 1 shows a fluid injector 10, which is shown in an exploded view in FIG. 2 and in cross-section in FIG. 3. Taking these Figures together the unit 10 can be seen to comprise a piston 11 which reciprocates in a piston chamber within a housing formed from an assembly of components. The piston chamber in which the piston 11 reciprocates is provided by a housing component 12. The piston 11 defines with the housing component 12, a valve seat member 13 and a part of a delivery nozzle 14, a fluid pumping chamber 15 which varies in volume with motion of the piston 11. The injector 10 comprises an electrical coil 16 which surrounds an annular boss 12*a* of the housing component 12 and which can be energised to slide the piston 11 in a direction which increases volume of the fuel pumping chamber 15.

The fuel injector 10 is provided with a return spring 17 which acts between the piston 11 and an end stop 18 which is secured in an annular bore in a cover 19 provided for the injector unit 10.

In FIGS. 1 to 3 there can be seen electrical contacts 20 and 21 which allow flow of current through the electrical coil 16.

The valve seat component 13 is castellated in nature on its outer surface to provide apertures, e.g. 22, 23 (see FIG. 1) which allow flow of fuel into the fluid injector unit 10. It is envisaged that at least a part of the fuel injector 10 comprising the valve seat portion 13 will be immersed in gasoline fuel, e.g. by positioning the injector unit 10 within a fuel tank or fuel chamber. An output section 14*a* of the delivery nozzle 14 will extend out of the fuel tank to deliver fuel into an intake passage of an internal combustion engine (not shown).

Fuel will flow through the apertures such as 22 and 23 in the castellated valve seat 13 to an annular gallery 24 defined between an interior surface of the valve seat member 13 and a part of the exterior surface of the delivery nozzle 14. There can be seen in FIG. 3 complimentary facing surfaces 24*a* and 14*b* of the valve seat component 13 and delivery nozzle 14 which together define the annular gallery 24 for delivery of fuel to the fuel pumping chamber.

Also seen in FIG. 3 is a one-way outlet valve controlling flow of fuel out of the fuel pumping chamber, the outlet valve comprising an outlet valve element 25 acted on by an outlet valve spring 26 which is seated in an outlet valve seat 27 secured in the annular output section 14*a*. The outlet valve seat 27 defines a flow path with a curved upstream end 27*a* and a sharp-edged downstream edge 27*b* defining an orifice 31.

The output valve member 25 has a hemispherical sealing surface 28 provided by a cap 28 separate to and affixed to the remainder of the valve member 25. The sealing surface is provided by a cap 28 of a material chosen for its good properties in surface finish etc. to provide for reliable sealing and also good fluid flow. The cap 28 extends over a hemispherical face of the valve member 25, which also defines a shoulder 29 which is engaged by the outlet valve spring 26.

The shape of the outlet valve member 25 is deliberately chosen to ensure that there is good sealing between the cap 28 and a frusto-conical interior sealing surface 14*c* of the delivery nozzle 14. The use of a hemispherical cap 28 and a frusto-conical sealing surface 14*a* removes the need for close tolerance in axial alignment of the valve member 25 with the central axis of the frusto-conical surface 14*c*. The hemispherical surface 28 also acts with the frusto-conical surface 14*c* to provide some centring force on the valve member 25.

The action of the piston spring 17 on the piston 11 forces fuel from the pumping chamber 15 through an outlet passage 30 and then over the hemispherical cap 28. The valve body 25 deliberately tapers in radius away from the valve cap 28, in order to encourage a desired flow of the delivered gasoline. The abrupt change provided by the shoulder 29 encourages the fuel flow past the valve member 25 to become turbulent and therefore ensures good mixing. The internal surface 27*a* of the valve seat 27 is provided with a smoothly curving shape leading to a delivery orifice 31, in order to encourage good flow of fuel to and through the delivery orifice 31. The sharp-edged downstream edge 27*b* encourages turbulent flow of fuel leaving the orifice 31 and therefore aids atomisation.

A one-way inlet valve 32 controls admission of fuel into the pumping chamber 15 from the annular gallery 24. The intake valve 32 is shown in plan view in FIG. 4 and in perspective in FIG. 5.

The one-way intake valve 32 comprises an annular outer support 33 and an inner annular sealing member 34, connected together by three spring arms 35, 36 and 37. Each spring arm is curved in nature and extends from a point on the annular outer support ring 33 circumferentially around the inner annular sealing member 34 to a point on the inner annular sealing member 34 which is spaced apart from the point where the spring arm is attached to the outer annular support. In other words, taking from the centre of the annular intake valve a radius extending through the point at which a spring arm connects to the inner annular sealing element then there will be an angle of more than 10° between this radius and a radius which extends from the centre of the annular intake valve through the point at which the same spring arm connects to the outer annular support. This configuration allows a length of spring arms sufficient to give a desired biasing effect. The one-way inlet valve 32 is preferably stamped or etched or cut (e.g. laser cut) as a single integer out of sheet metal.

FIGS. 6*a*, 6*b* and 6*c* show a sub-assembly comprising the valve seat element 13 and the delivery nozzle 14. The components together define a piston chamber end face as a flat sealing surface 40 for the annular intake valve 32. The valve seat element 13 has a central circular aperture 101 of a first diameter. The delivery nozzle 14 has an annular front surface 102 of an external diameter less than the diameter of the aperture 101. An annular intake orifice 100 is defined between an outer edge of the surface 102 and an inner edge of the annular surface of valve seat element 40. An outlet passage 104 through the delivery nozzle 14 opens on the pumping chamber via a circular outlet orifice surrounded by the annular surface 102 of the delivery nozzle 14. The annular sealing element 34 aligns with and seals the annular intake orifice 100 defined by the aperture 101 of the sealing surface 40 and the front 102 of the nozzle 14, via which annular orifice 100 the annular gallery 46 opens into the pumping chamber.

FIGS. 7*a* and 7*b* show schematically the operation of the fuel injector. FIG. 7*a* shows (in an exaggerated fashion for purposes of illustration) motion of the piston 11 upwardly, under influence of a field generated by the electrical coil 16. The upward movement of the piston 11 increases the volume of the fuel pumping chamber 15. This draws fuel into the fuel pumping chamber 15 through the annular inlet passage 24 via the open one way inlet valve 32.

The drawing of the fuel into the chamber 15 reduces the pressure throughout the fuel. It is likely that the fuel will have some amount of gas dissolved in it and also that the fuel could become two-phase with the reduced intake pressure. This then limits the filling, i.e. suction, pressure to the vapour pressure of the fuel being drawn into the fuel pumping chamber 15 and this therefore limits the filling speed of the chamber 15. In order to minimise this effect and thereby allow high speed operation of the positive displacement pumping action of the piston 11, the intake passage area needs to be large and the profile of the passage smooth. The intake valve also needs to have a large working area. The provision of the annular intake orifice 24 as described above, co-operating with an annular sealing element of intake valve 32, provides a novel arrangement that gives a large flow area and low flow restriction during the intake phase of the pumping cycle.

When the fuel pumping chamber 15 has been filled with fuel then the coil 16 is de-energised and the valve spring 17 then forces the piston 11 to expel fuel to the pumping chamber 15. The outlet valve member 25 will move away from its valve seat because of the fluid pressure of the expelled fuel and the one way outlet valve thus opened will allow expulsion of fuel from the chamber 15. The one way intake valve 32 will close to seal the intake passage 24, the valve closing both under the action of the fluid pressure in the fuel pumping chamber 15 and also the spring force provided by the spring arms 35, 36 and 37.

The arrangement of the annular intake passage 14 in part defined by the same component which defines the outlet passage 30 and contains the outlet valve 25 enables some beneficial heat exchange to take place between the fuel delivered into the pumping chamber 15 and the fuel leaving the pumping chamber 15. It is desirable to stop the fuel vaporising prior to its delivery to the pumping chamber and this can be achieved by keeping the fuel cool, while it is an advantage that the delivered fuel evaporates in order to ensure subsequent good combustion. Since the fuel will evaporate in the area of the outlet valve 25, the cooling effect of this evaporation is advantageously passed through the nozzle 14 to the fuel in the inlet passage 24 (or, considered in reverse, the heat of the fuel in the inner passage 24 passes through the nozzle 14 to heat the dispensed fuel).

When the piston 11 reaches the end of its pumping stroke it abuts the intake valve 32 and then clamps the inlet valve 32 against the valve seat provided by the valve seat member 13 and the outlet nozzle 14. There is significant benefit in positively closing the annular intake passage 14 using the force of the piston spring 17 to ensure a good positive seal. This permits the spring force applied by the spring arms 35, 36, 37 to be reduced significantly since this force is not solely relied upon to ensure a complete seal of the annular passage 14, during a dwell period in which both the one way inlet valve and the one way outlet valves are closed. The reduction in the spring force ensures that the intake valve 32 is easy to open at the beginning of the next intake stroke and minimises any restriction on the incoming flow caused by the need to induce a pressure drop across the intake valve solely to hold it open against the spring load of the spring arms 34, 35, 36, 37.

The arrangement allows the pumping piston 11 to work at higher speeds than would be possible if the spring force of the spring arms is alone used to close the intake valve 32. The system also works to prevent any uncontrolled additional fluid being drawn from the annular inlet 24 through the pumping volume 15 by the momentum of the outgoing fluid passing through the outlet passage 30 drawing fluid into the chamber 15 past the intake valve 32.

By providing for clamping of the annular valve 34 shut using the piston 11, it may be possible to dispense with return springs for the intake valve altogether, in which case the intake valve could become a floating component free to move axially within the pumping chamber 15. This possibility is shown in FIGS. 8*a* and 8*b*. In 8*b* it can be seen that the intake valve 32 has been clamped in place sealing the annular intake passage 14.

The applicant has also realised that the end face of the piston 11, which in part defines the variable volume pumping chamber 15, can advantageously be configured to improve filling of the pumping chamber. FIG. 9 shows a cross-head design feature on the front of the face of the piston 11, this being indicated in FIGS. 8*a* and 8*b* by the recess 40 shown in the Figures. The recess 40 is provided by a cross shaped groove on the piston face, illustrated in FIG. 9. This design feature allows the fuel to flow freely around the intake valve to maximise filling of the pumping chamber. The same design feature prevents the annular sealing element of the inlet valve 32 becoming stuck to the face of the piston by allowing fluid to get behind the inlet valve 32 and thus allowing the valve 32 to separate from the piston 11 rapidly. The specially shaped piston 11 is still able to clamp the inlet valve 32 against the sealing surface, closing the inlet passage 24, as previously described.

FIGS. 10*a* and 10*b* are respectively an end view and a cross section through a further variant of piston 11, showing a different cruciform shape 41 over the piston face; the cruciform shape 41 is formed by two orthogonal machining operations on the piston face. FIGS. 11*a* and 11*b* and 11*c* show yet a further variant with a star shaped configuration 42 on the piston face, formed by three diametrically extending grooves which intersect at the centre of the face and which are angled with respect to each other. The arrangements of FIGS. 10*a* to 11*b* have the same advantages of allowing good flow of fuel around the intake valve 32 and ensuring quick separation of the annular sealing surface of the intake valve from the piston.

In FIGS. 6*a*, 6*b*, 6*c* the valve seat element 13 and delivery nozzle 14 are separate components (typically of metal). They could be replaced by the single component 1200 illustrated in FIGS. 12*a* to 12*d*, this component could be made of metal or could be a component moulded from a plastics material. There can be seen in FIG. 12*a* a bore 1250 in which the one-way outlet valve will be mounted; this has a frusto-conical surface 1214*c* against which the hemispherical end 28 of the outlet valve will seal. The component 1200 provides a flat sealing surface 1240 for the annular intake valve 32 and a part of the piston chamber end face. A segmented annular intake orifice is provided in the surface 1240, comprised of arc segments 12100, 12010, 12102 and 12103, which share a common centre of curvature, i.e. which all lie on a common circle centred on the outlet passage 12104. When reference is made to an annular inlet orifice in the application it should be considered to include both a continuous annular orifice and a segmented annular orifice. The arc segments are divided by dividing walls 12015, 12016, 12107 and 12108, which extend radially between the sealing surface 1240 and an annular surface 12102 which surrounds and defines a circular outlet orifice for circular cross-section outlet passage 12104. External apertures e.g. 1222, 1223, 1224, allow flow of fuel into the fuel injector via the passage 1246. At least the part of component 1200 comprising the apertures 1222, 1223, 1224 will be immersed in gasoline fuel (or other fluid) in use, e.g. by protecting the injector unit in a fuel tank or chamber (or tank or chamber of fluid).

Whilst above the injector has been described in its use in the injection of fuel in an internal combustion engine and the injector is especially good in this application, the injector could be used to deliver any fluid. In previous patent applications the applicant has described how its injectors could be used to deliver urea into the exhaust gasses of a diesel engine or lubricant to bearings within an engine, by delivering the liquid lubricant directly to the bearings concerned with the injector located in close proximity. Other exhaust after-treatment fluids could be injected into the exhaust pipe of an engine and cooling water could also be injected where needed, e.g. to cool a catalytic converter.

Whilst in the above described embodiments an electrical coil is used to apply a force on the piston acting to increase the volume of the pumping chamber and draw fluid into the pumping chamber, whilst a spring is used to apply a force on the piston acting to reduce the volume of the pumping chamber and expel fluid from the pumping chamber, the opposite operation is also possible, i.e. the coil could be used to apply a force on the piston acting to reduce the volume of the pumping chamber and expel fluid therefrom, while the piston spring is used to apply a force on the piston acting to increase the volume of the pumping chamber and draw fluid into the chamber.

Instead of using an electrical coil and piston spring the injector could use a stack of piezo-electric elements connected to the piston. A varying voltage would be applied to the stack to cause the elements to cyclically expand and contract and hence move the piston to draw in and expel fluid from the pumping chamber.

It is possible that the unit could be separated from the point of fluid delivery and e.g. used as a pump connected by a conduit to a physically separate delivery nozzle.

The invention claimed is:

1. A fluid injector which functions as a positive displacement pump and comprises:

a housing in which a piston chamber is formed;

a piston which reciprocates in the piston chamber to define therewith a variable volume fluid pumping chamber;

a one-way inlet valve which allows flow of fluid into the pumping chamber from a fluid inlet;

a one-way outlet valve which allows flow of fluid out of the pumping chamber to a fluid outlet; wherein in operation of the injector the piston cyclically moves to increase volume of the pumping chamber and draw fluid into the pumping chamber via the one-way inlet valve and then the piston moves to decrease volume of the pumping chamber and expel fluid from the pumping chamber via the one-way outlet valve;

characterised in that:

the fluid inlet comprises an inlet passage through the housing which opens on to the pumping chamber as an inlet orifice provided in an end face of the piston chamber, the piston chamber end face facing an opposed piston face of the piston;

the fluid outlet comprises an outlet passage through the housing which opens onto the pumping chamber via an outlet orifice in the piston chamber end face spaced apart from the inlet orifice; and the one-way inlet valve comprises a sealing element which is aligned with the inlet orifice and which can engage the piston end face spanning the inlet orifice to seal the inlet orifice.

2. A fluid injector as claimed in claim 1 wherein the inlet orifice is an annular inlet orifice and the sealing element is an annular sealing element.

3. A fluid injector as claimed in claim 2 wherein the annular inlet orifice is a continuous annular orifice.

4. A fluid injector as claimed in claim 2 wherein the annular inlet orifice is a segmented annular orifice.

5. A fluid injector as claimed in claim 1 wherein the annular sealing element is connected to a surrounding annular support of the inlet valve by a plurality of curved spring arms.

6. A fluid injector as claimed in claim 5 wherein each spring arm extends from a point of attachment with the annular support circumferentially around the annular sealing element to a point of attachment with the annular sealing element.

7. A fluid injector as claimed in claim 2 wherein the outlet orifice is provided within the annular inlet orifice.

8. A fluid injector as claimed in claim 7 wherein the piston chamber end face is provided by a sub-assembly of components of the housing, the sub-assembly comprising a delivery nozzle via which fluid is delivered from the fluid injector and a valve seat element mounted on the delivery nozzle; wherein, the delivery nozzle has an annular surface which provides a part of the piston chamber end face and which surrounds the outlet orifice; and the valve seat element provides a part of the piston chamber end face and has an aperture of an internal diameter greater than an external diameter of the delivery nozzle annular surface with the annular inlet orifice defined between an internal edge of the annular surface of the valve seat element and an external edge of the annular surface of the delivery nozzle.

9. A fluid injector as claimed in claim 8 wherein the delivery nozzle has an external curved surface which faces a matching internal surface of the valve seat member with the facing curved surfaces defining between them the fluid inlet passage in the sub-assembly.

10. A fluid injector as claimed in claim 9 wherein the valve seat element has a castellated lower edge which abuts and engages a facing surface of the delivery nozzle in the sub-assembly, the castellations defining apertures therebetween via which fluid can flow to the fluid inlet passage.

11. A fluid injector as claimed in claim 8 wherein a fluid outlet passage extends through the fluid delivery nozzle and the one-way outlet valve comprises an outlet valve element provided in the outlet passage and an outlet valve spring acting between the outlet valve element and an outlet valve spring seat provided in the fluid delivery nozzle, the outlet valve spring biasing the outlet valve element into engagement with an outlet valve seat provided by an internal surface of the fluid delivery nozzle.

12. A fluid injector as claimed in claim 11 wherein the outlet valve element is provided with a domed cap which engages the outlet valve seat and where the outlet valve seat is frusto-conical.

13. A fluid injector as claimed in claim 11 wherein the fluid delivery nozzle is fabricated from a heat conducting material whereby heat is exchanged between fluid in the fluid inlet passage and fluid in the fluid outlet passage.

14. A fluid injector as claimed in claim 7 wherein the piston chamber end face is provided by a single component which provides a delivery nozzle via which fluid is delivered from the fluid injector and a valve seat; wherein, the delivery nozzle has an annular surface which provides a part of the piston chamber end face and which surrounds the outlet orifice; and the valve seat provides a part of the piston chamber end face and has an aperture of an internal diameter greater than an external diameter of the delivery nozzle annular surface with the annular inlet orifice defined between an internal edge of the annular surface of the valve seat and an external edge of the annular surface of the delivery nozzle.

15. A fluid injector as claimed in claim 14 wherein the component has apertures in an outer surface thereof via which fluid can flow to the fluid inlet passage.

16. A fluid injector as claimed in claim 14 wherein a fluid outlet passage extends through the fluid delivery nozzle and the one-way outlet valve comprises an outlet valve element provided in the outlet passage and an outlet valve spring acting between the outlet valve element and an outlet valve spring seat provided in the fluid delivery nozzle, the outlet valve spring biasing the outlet valve element into engagement with an outlet valve seat provided by an internal surface of the fluid delivery nozzle.

17. A fluid injector as claimed in claim 16 wherein the delivery nozzle has an external curved surface which faces a matching internal surface of the valve seat member with the facing curved surfaces defining between them the fluid inlet passage.

18. A fluid injector as claimed in claim 16 wherein the fluid delivery nozzle is fabricated from a heat conducting material whereby heat is exchanged between fluid in the fluid inlet passage and fluid in the fluid outlet passage.

19. A fluid injector as claimed in claim 1 wherein the piston can abut the annular sealing element and force the annular sealing element into sealing engagement with the piston chamber end face, with the annular sealing element clamped between the piston and the piston chamber end face.

20. A fluid injector as claimed in claim 1 wherein the piston is provided with a recess aligned with the annular sealing element which allowed fluid to flow around the annular sealing element.

21. A fluid injector as claimed in claim 20 wherein the recess is provided by grooves which define a cross shape in the piston face.

22. A fluid injector as claimed in claim 20 wherein the recess is provided by grooves which define a star shape in the piston face.

23. A fluid injector which functions as a positive displacement pump and comprises:

a housing in which a piston chamber is formed;

a piston which reciprocates in the piston chamber to define therewith a variable volume fluid pumping chamber;

a one-way inlet valve which allows flow of fluid into the pumping chamber from a fluid inlet;

a one-way outlet valve which allows flow of fluid out of the pumping chamber to a fluid outlet; wherein in operation of the injector the piston cyclically moves to increase volume of the pumping chamber and draw fluid into the pumping chamber via the one-way inlet valve and then the piston moves to decrease volume of the pumping chamber and expel fluid from the pumping chamber via the one-way outlet valve;

characterised in that:

the fluid inlet comprises an inlet passage through the housing which opens on to the piston chamber via an inlet orifice in an end face of the piston chamber, the piston chamber end face facing an opposed piston face of the piston;

the one-way inlet valve comprises a sealing element located in the pumping chamber which is aligned with the inlet orifice and which can engage the piston chamber end face spanning the inlet orifice to seal the inlet orifice; and the piston can abut the sealing element to force the sealing element into sealing engagement with the piston chamber end face, with the sealing element clamped between the piston and the piston chamber end face.

24. A fluid injector as claimed in claim 23 wherein the piston face is provided with a recess aligned with the sealing element which allows fluid to flow around the sealing element.

25. A fluid injector as claimed in claim 24 wherein the recess is provided by grooves which define a cross shape in the piston face.

26. A fluid injector as claimed in claim 24 wherein the recess is provided by grooves which define a star shape in the piston face.

27. A fluid injector which functions as a positive displacement pump and comprises:

a housing in which a piston chamber is formed;

a piston which reciprocates in the piston chamber to define therewith a variable volume fluid pumping chamber;

a one-way inlet valve which allows flow of fluid into the pumping chamber from a fluid inlet;

a one-way outlet valve which allows flow of fluid out of the pumping chamber to a fluid outlet; wherein in operation of the injector the piston cyclically moves to increase volume of the pumping chamber and draw fluid into the pumping chamber via the one-way inlet valve and then the piston moves to decrease volume of the pumping chamber and expel fluid from the pumping chamber via the one-way outlet valve;

characterised in that:

the fluid inlet comprises an inlet passage through the housing which opens on to the pumping chamber via an inlet orifice in an end face of the piston chamber, the piston chamber end face facing an opposed piston face of the piston;

the one-way inlet valve comprises a sealing element located in the pumping chamber which is aligned with the inlet orifice and which can engage the piston chamber end face spanning the inlet orifice to seal the inlet orifice; and the piston face is provided with a recess aligned with the sealing element which allows fluid to flow around the sealing element.

28. A fluid injector as claimed in claim 27 wherein the recess is provided by proves which define a cross shape in the piston face.

29. A fluid injector as claimed in claim 27 wherein the recess is provided by grooves which define a star shape in the piston face.

30. A fluid injector as claimed in claim 1 wherein:

an electrical coil is provided in the housing surrounding the piston and generates a field which applies a force on the piston in a first direction;

a piston spring acts between the piston and the housing to apply a biasing force on the piston in a second direction opposite to the first direction; and in operation of the injector one of the electrical coil and the piston spring applies a force on the piston acting to move the piston to draw fluid into the pumping chamber and the other of the electrical coil and the piston spring applies a force on the piston acting to expel the fluid from the pumping chamber.

31. A fluid injector as claimed in claim 1 wherein the piston is connected to a piezo-electric element which in operation of the injector expands and contract with application of a varying voltage thereacross.

32. A fluid injector as claimed in claim 1 wherein the piston reciprocates between two end stops which ensure that the piston has a set distance of travel in each operation.

33. An internal combustion engine comprising:

a combustion chamber;

an air intake system for delivering charge air to the combustion chamber;

an exhaust system for relaying combusted gas from the combustion chamber to atmosphere; and a fuel injection system for delivering fuel into the charge air to form a fuel/air mixture which is subsequently combusted in the combustion chamber; wherein the fuel injection system uses a fluid injector as claimed in claim 32 to dispense an amount of fuel fixed for each and every operation of the engine;

an electronic controller controls operation of the fluid injector;

in each of at least a majority of engine cycles the fluid injector is generated on a plurality of occasions by the controller;

in response to an increasing engine speed and/or load the controller increases in amount the fuel delivered per engine cycle by increasing in number the occasions the fuel injector is operated per engine cycle; and in response to a decreasing engine speeds and/or load the controller reduces in amount the fuel delivered per engine cycle by reducing in number the occasions the fuel injector is operated per engine cycle.

34. A positive displacement pump which comprises:

a housing in which a piston chamber is formed;

a piston which reciprocates in the piston chamber to define therewith a variable volume fluid pumping chamber;

a one-way inlet valve which allows flow of fluid into the pumping chamber from a fluid inlet;

a one-way outlet valve which allows flow of fluid out of the pumping chamber to a fluid outlet; wherein in operation of the injector the piston cyclically moves to increase volume of the pumping chamber and draw fluid into the pumping chamber via the one-way inlet valve and then the piston moves to decrease volume of the pumping chamber and expel fluid from the pumping chamber via the one-way outlet valve;

characterised in that:

the fluid inlet comprises an inlet passage through the housing which opens on to the pumping chamber as an annular inlet orifice provided in an end face of the piston chamber, the piston chamber end face facing an opposed piston face of the piston;

the fluid outlet comprises an outlet passage through the housing which opens on to the pumping chamber via an outlet orifice in the piston chamber end face spaced apart from the annular inlet orifice; and the one-way inlet valve comprises an annular sealing element which is aligned with the annular inlet orifice and which can engage the piston end face spanning the annular inlet orifice to seal the annular inlet orifice.

35. A pump as claimed in claim 34 wherein the inlet orifice is an annular inlet orifice and the sealing element is an annular sealing element.

36. A pump as claimed in claim 35 wherein the annular inlet orifice is a continuous annular orifice.

37. A pump as claimed in claim 35 wherein the annular inlet orifice is a segmented annular orifice.

38. A positive displacement pump which comprises:

a housing in which a piston chamber is formed;

a piston which reciprocates in the piston chamber to define therewith a variable volume fluid pumping chamber;

a one-way inlet valve which allows flow of fluid into the pumping chamber from a fluid inlet;

a one-way outlet valve which allows flow of fluid out of the pumping chamber to a fluid outlet; wherein in operation of the injector the piston cyclically moves to increase volume of the pumping chamber and draw fluid into the pumping chamber via the one-way inlet valve and then the piston moves to decrease volume of the pumping chamber and expel fluid from the pumping chamber via the one-way outlet valve;

characterised in that:

the fluid inlet comprises an inlet passage through the housing which opens on to the piston chamber via an inlet orifice in an end face of the piston chamber, the piston chamber end face facing an opposed piston face of the piston;

the one-way inlet valve comprises a sealing element located in the pumping chamber which is aligned with the inlet orifice and which can engage the piston chamber end face spanning the inlet orifice to seal the inlet orifice; and the piston can abut the sealing element to force the sealing element into sealing engagement with the piston chamber end face, with the sealing element clamped between the piston and the piston chamber end face.

39. A positive displacement pump which comprises:

a housing in which a piston chamber is formed;

a piston which reciprocates in the piston chamber to define therewith a variable volume fluid pumping chamber;

a one-way inlet valve which allows flow of fluid into the pumping chamber from a fluid inlet;

a one-way outlet valve which allows flow of fluid out of the pumping chamber to a fluid outlet; wherein in operation of the injector the piston cyclically moves to increase volume of the pumping chamber and draw fluid into the pumping chamber via the one-way inlet valve and then the piston moves to decrease volume of the pumping chamber and expel fluid from the pumping chamber via the one-way outlet valve;

characterised in that:

the fluid inlet comprises an inlet passage through the housing which opens on to the pumping chamber via an inlet orifice in an end face of the piston chamber, the piston chamber end face facing an opposed piston face of the piston;

the one-way inlet valve comprises a sealing element located in the pumping chamber which is aligned with the inlet orifice and which can engage the piston chamber end face spanning the inlet orifice to seal the inlet orifice; and the piston face is provided with a recess aligned with the sealing element which allows fluid to flow around the sealing element.

* * * * *